United States Patent [19]

Mocarski

[11] 3,942,724

[45] Mar. 9, 1976

[54] VARIABLE THROAT NOZZLE

[75] Inventor: Zenon R. Mocarski, Easton, Conn.

[73] Assignee: S.R.C. Laboratories, Inc., Fairfield, Conn.

[22] Filed: Aug. 1, 1974

[21] Appl. No.: 493,567

[52] U.S. Cl. ..... 239/417; 239/434.5; 417/193

[51] Int. Cl.[2] ..... B05B 7/00

[58] Field of Search ..... 417/182, 185, 192, 193; 239/318, 341, 412, 417, 417.3, 434.5, 534, 535

[56] References Cited

UNITED STATES PATENTS

| | | | |
|---|---|---|---|
| 344,480 | 6/1886 | Holden et al. | 417/193 |
| 414,098 | 10/1889 | Westphal | 417/193 |
| 2,914,084 | 11/1959 | McLean et al. | 239/534 UX |
| 2,937,802 | 5/1960 | Fisher | 417/185 |
| 2,998,198 | 8/1961 | Young | 239/534 X |
| 3,791,764 | 2/1974 | Summer | 417/193 X |

*Primary Examiner*—John J. Love

*Attorney, Agent, or Firm*—Ernest M. Junkins

[57] ABSTRACT

A nozzle having a through passageway in which the flow of pressurized fluid induces the flow of secondary fluid therethrough with the passageway having a throat that is adjustable in cross-sectional extent to enable the nozzle to efficiently operate over a wide range of operating conditions. The throat extent may be automatically changed with a change in the operating condition within its range or as in one embodiment be easily set for one operating condition.

9 Claims, 6 Drawing Figures

VARIABLE THROAT NOZZLE

The present invention relates to the movement of a secondary fluid by a pressurized fluid and especially to a nozzle formed to provide a through passageway with an entrance and an exit. Pressurized fluid is caused to flow through the passageway to induce the flow of secondary fluid into the entrance with the combined fluids being discharged from the exit. In a Venturi type nozzle having a circular passageway, a minimum diameter is formed somewhat adjacent the entrance and is generally referred to as the nozzle throat. When pressurized fluid flows by the throat it creates a reduced pressure or suction which induces the flow of the secondary fluid.

The capability of a nozzle to cause movement of secondary fluid for a quantity of pressurized fluid depends on many factors including the value of the ambient discharge pressure, the value of the suction at the entrance and the values of the quantity and pressure of the pressurized fluid. One operating condition has one value for each of the above factors and a nozzle's dimensions may be selected which, for this one condition. provides for the maximum amount of secondary fluid flow and hence the best operating efficiency of the nozzle. However, if the actual operating condition departs from the selected condition by a change in one or more values, the efficiency of the nozzle decreases quite rapidly. Thus, a nozzle selected for a condition of low suction, where it efficiently causes a high secondary fluid flow is only capable of producing a somewhat higher value of suction before it stops inducing flow. On the other hand, a nozzle dimensioned for a condition of high suction and low secondary fluid flow where it is quite efficient, will be very inefficient for conditions of low values of suction as it will not induce a much greater flow of secondary fluid.

It is accordingly an object of the present invention to provide a nozzle which is capable of being easily adjusted to a selected operating condition within a wide range of possible operating conditions.

Another object of the present invention is to provide a nozzle that is capable of efficiently operating over a wide range of operating conditions and which will automatically adjust to a change in an operating condition to thereby maintain efficient operation at such a new condition.

A further object of the present invention is to achieve the above objects with a nozzle that has a throat which is adjustable in cross-sectional extent, either manually or automatically.

Still another object of the present invention is to achieve the above objects with a nozzle that is extremely simple in construction, reliable and durable in use, easily set to an operating condition and which is economical to fabricate.

In carrying out the present invention, there is provided in the specific embodiment shown, a Venturi type nozzle having a passageway that includes an entrance, an exit and a minimum diameter or cross-sectional area throat portion. A jet of pressurized fluid is directed into the entrance and a source of secondary fluid is caused to communicate with the entrance. The flow of pressurized fluid creates a reduced pressure or suction at the entrance which induces the flow of the secondary fluid into and through the passageway.

The throat of the passageway is formed to be adjustable so that its diameter or cross-sectional extent is capable of being changed. Relatively large throats are efficient for low values of suction conditions while smaller throats are capable of producing high values of suction. In the specific embodiment herein disclosed, the passageway is circular and the throat is defined by the inner surface of an annular ring. The ring is formed of resilient material and by its deformation, the diameter of the inner surface may be varied to thereby change the throat diameter.

If the nozzle is desired to be operated at only one selected condition, the ring is manually deformed to have its diameter set for efficient operation at the values of the selected condition. If, on the other hand, the nozzle is desired to be efficiently operated at different conditions within its range and to adapt itself automatically to the instant operating condition, then the ring is made to be deformable in accordance with the values of the condition, preferably the instant value of the suction at the nozzle entrance. The nozzle will then for low values of suction at the entrance have a large diameter which induces a relatively large flow of secondary fluid while as the entrance suction value increases, the throat will decrease in cross-sectional extent to increase the suction value, thereby adjusting itself to the operating condition.

Other features and advantages will hereinafter appear. In the drawing.

Figure 1:
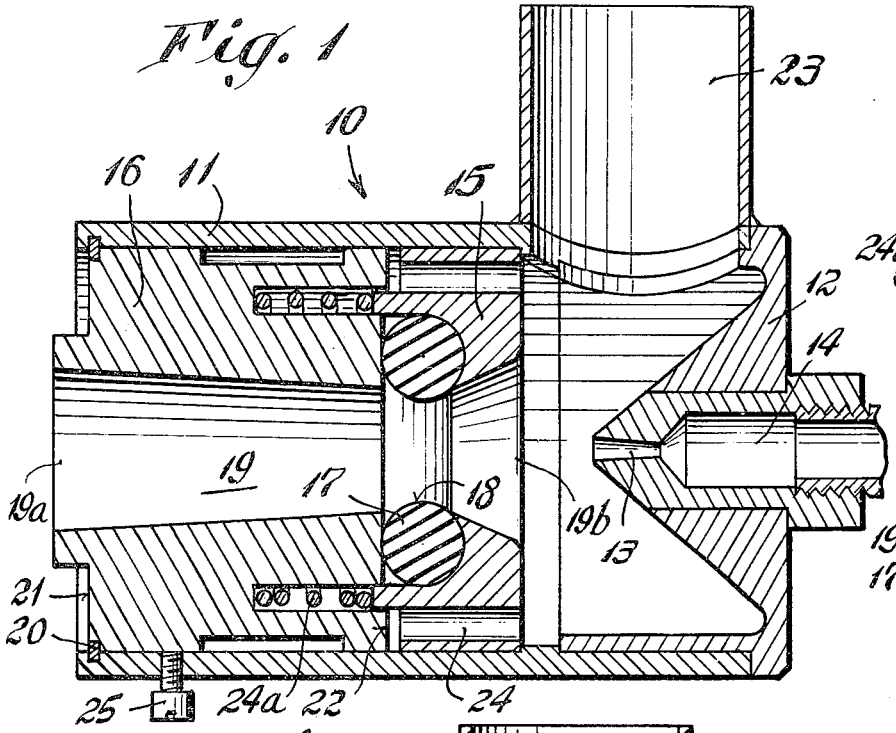
FIG. 1 is a diametric cross-section of one embodiment of a nozzle of the present invention.
Figure 2:
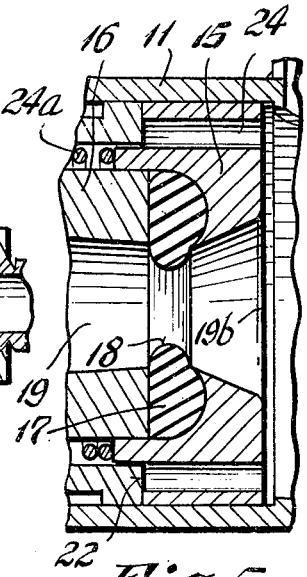
FIG. 2 is a diametric cross-sectional detail of the nozzle of FIG. 1 showing a different extent of the throat.

Referring to the drawing, the nozzle shown in FIGS. 1 and 2 is generally indicated by the reference numeral 10 and includes a tubular housing 11. A cap 12 closes one end of the housing 11 and is provided with an opening 13 which communicates through a duct 14 to a source of pressurized fluid (not shown) such that the pressurized fluid will be ejected from the opening 13 as a jet. If desired, and not shown, valve means may be incorporated to control the flow of pressurized fluid. Secured intermediate the housing is an entrance forming member 15 and an exit forming member 16 both having the cross-sectional shape shown. Positioned between the two members 15 and 16 is an annular ring 17 formed of resilient material, such as rubber and which has an inner surface 18 that is the minimum diameter or cross-sectional extent of a passageway 19 formed through the members 15, 16 and 17. The inner surface 18 thus constitutes the throat of the nozzle.

The member 16 is relatively movable with respect to the member 15 and is held within the housing 11 as by a C-ring 20. The exit member 16 further has an exterior surface 21 which is subject to the pressure at the exit **19*a* of the passageway. The other end of the member 16 has a surface 22 which is subject to the pressure within the housing which is generally that existing at the entrance 19*b* of the passageway. A conduit 23 communicates the interior of the housing 11 with a source of secondary fluid (not shown) so that a jet of pressurized fluid issuing from the opening 13 through the passageway 19 creates a reduced pressure or suction at the entrance of the passageway which in turn induces the flow of secondary fluid through the conduit 23 and then through the passageway. The pressure at the entrance is transmitted as by apertures 24 formed in the member 15 to the surface 22 of the member 16.**

With the nozzle operating, the exterior pressure exerted on the surface 21 and the entrance pressure exerted on the surface 22 will exert a force by reason of the pressure difference which tends to move the member 16 towards the member 15 as the exterior pressure is higher than the entrance pressure. In doing so, it compresses the throat forming ring 17 to deform it. As the difference in pressure increases, greater movement occurs and the deformation of the ring 17 increases, causing it to assume a shape such as shown in FIG. 2. The deformation results in a bulging outwardly of the inner surface 18 which decreases its diameter and thus decreases the cross-sectional extent of the throat. The decrease of the throat area enables the nozzle to efficiently operate for a condition of higher suction than if it had maintained the extent shown in FIG. 1.

The extent of the reduction in the throat cross-sectional extent is in one example, a reduction from five-eighths of an inch in diameter which would be the extent produced for the operating position of the parts shown in FIG. 1 to about one-half an inch in diameter as shown in FIG. 2. This, in effect reduces the cross-sectional throat area by approximately 25 percent or by a ratio of 25/64 to 16/64ths.

For intermediate values of pressures between the values of pressures which enable the ring 17 to maintain its basically undeformed shape shown in FIG. 1 and the values of pressures which cause the ring to assume the deformed shape in FIG. 2, the ring will adjust itself to a diameter which corresponds to the extent of the intermediate value pressures.

In some instances, the ring 17 may be formed of material which is sufficiently resilient to balance the force tending to deform it for the desired range of operating conditions. However, in other ranges, a spring 24*a* may be employed to set the values of the range of conditions over which deformation occurs.

The compressed force is directly related to the difference in the value of the pressures at the exit 19*a* and the entrance 19*b*. The entrance pressure may change by restricting the flow of secondary fluid while the exit pressure may change as when the nozzle is discharging into a closed container. In both instances, or a combination thereof, it is the pressure difference which controls the deformation and not an absolute value of other pressures.

While the nozzle shown in FIGS. 1 and 2 is capable of automatically adjusting its throat extent in accordance with the values of the pressures, it will also be apparent that if desired the throat extent may be set for one operating condition within its range. This may be easily achieved simply by the use of a set screw 25 that threadingly passes through the housing 11 to abut against the member 16 and hold it at the position selected.

Figure 3:
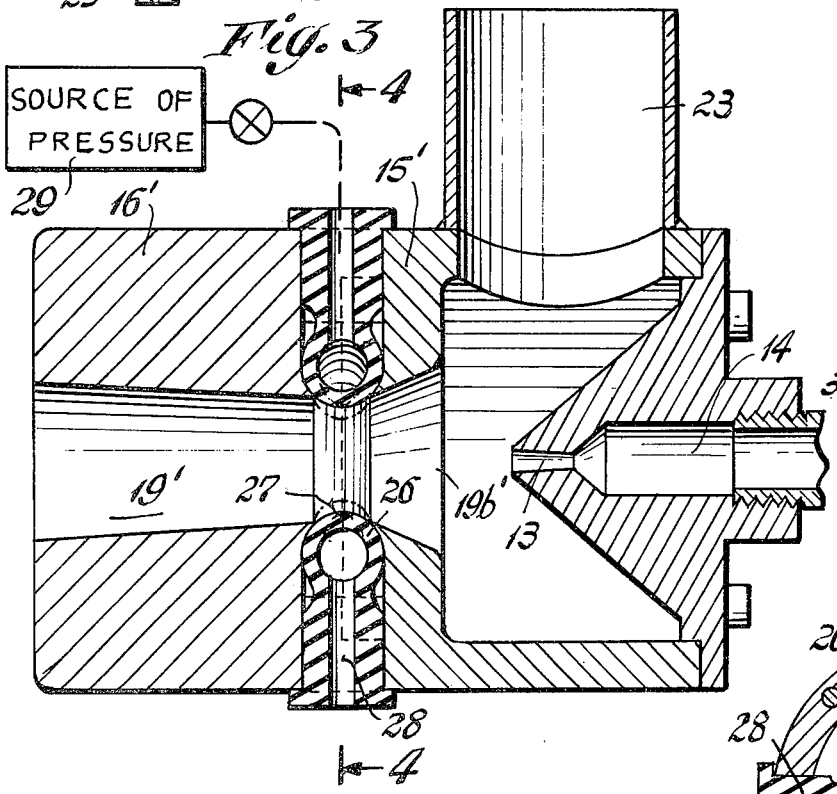
FIG. 3 is a diametric cross-section of another embodiment of the present invention.
Figure 4:
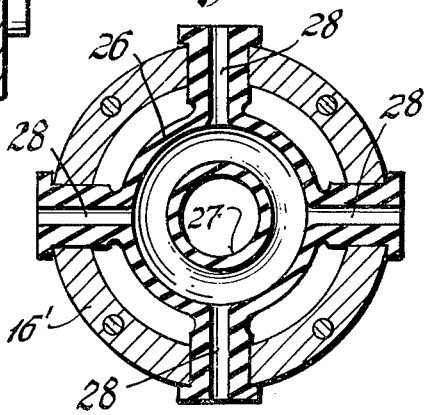
FIG. 4 is a section taken on line 4—4 of FIG. 3.

Shown in FIGS. 3 and 4 is a further embodiment of the nozzle of the present invention in which the throat forming member 26 is hollow and formed to have an inner surface 27 that defines the throat of a passageway 19'. The members 15' and 16' are fixed with relation to each other and the deformation of the member 26 depends on the values of pressure within the member 26 and at its interior surface 27 at the entrance 19*b'*. The interior of the throat member 15 may communicate with the atmosphere as by integral tubes 28 or if desired, it may be connected to a source of pressure 29 (either positive or negative) which may be adjusted and held at a desired value. In this latter instance, the value of entrance pressure which causes the deformation of the ring may thus be varied to set the range of operation of the nozzle, after taking into account the resistance of the member.

Figure 5:
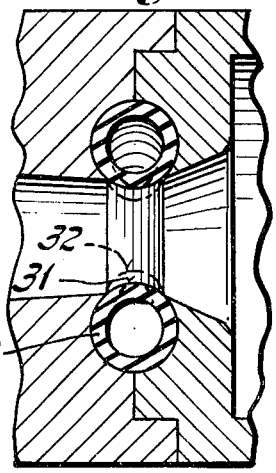
FIG. 5 is a diametric cross-sectional detail of a further embodiment of the nozzle of the present invention.

Shown in FIG. 5 is a further embodiment of a throat forming member which in this instance consists of a tubular ring 30 with a closed hollow chamber. The ring interior surface is deformable from its largest cross-sectional extent to its smaller extent indicated by the reference numerals 31 and 32, respectively and the extent of deformation depends upon the relative difference between the pressure initially within the ring and the pressure at the surface 31 which is essentially the entrance pressure.

Figure 6:
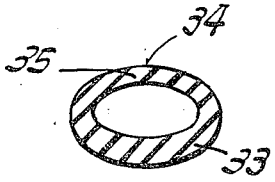
FIG. 6 is a radial cross-section of another embodiment of a throat forming member.

Shown in FIG. 6 is a radial cross-section of still another embodiment of a throat forming annular ring 33. In this embodiment rather than having the ring circular in cross-section, it is formed into an ellipse and also may have its inner surface 34 which defines the extent of the throat formed with a thinner wall 35 than the remaining walls.

It will also be clear that instead of being hollow, either member (30 or 33) may be solid with the resilience of the material being selected to provide the range of operating conditions, the ring 17 of FIGS. 1 and 2 being solid. On the other hand, any one of the hollow rings 26, 30 and 33 may be used with the movable member 16 in the embodiment shown in FIGS. 1 and 2, if desired.

It will be understood that a nozzle with a throat having a large extent enables a relatively high quantity of flow of secondary fluid to be induced at a low value of differential pressure and which in one embodiment of the invention, wherein the throat had a diameter of five-eighths of an inch, a suction of 5 inches of mercury was produced. On the other hand when the throat diameter was reduced to one-half inch in diameter, a suction of 11 inches of mercury was produced with, of course, a reduction in the quantity of secondary fluid flowing. The other factors of the operating conditions remained the same. Thus, the present invention enables not only a wider range of operating conditions to be experienced by the nozzle and especially the value of the suction created but enables the nozzle to operate extremely efficiently in accordance with the pressures instantly occurring within the range. Moreover, the ability to set the nozzle to operate at one selected operating condition within a wide range of operating conditions enables one nozzle to be utilized without physically altering it for any one of a plurality of conditions.

It will accordingly be understood that there has been disclosed a nozzle that is capable of operating efficiently over a wide variety of operating conditions. Such a nozzle depends upon being able to vary the extent of the minimum cross-sectional area of the passageway through which a pressurized fluid and a secondary fluid are caused to flow. In the specific embodiment shown the adjustablness of the throat extent is achieved by the utilization of a deformable member which has an inner surface that defines the extent of the throat. The extent of the deformation may be made to one selected value or may be made to be responsive, where conditions vary, to the instant operating condition such that the nozzle tends in the latter instance to automatically adjust itself for efficient operation.

Variations and modifications may be made within the scope of the claims and portions of the improvements may be used without others.

I claim:

1. A nozzle for inducing flow of a secondary fluid by using a pressurized fluid comprising means forming a passageway to have an entrance, an exit and an intermediate portion of minimum cross-sectional extent, means for causing a pressurized fluid to flow through the passageway, means for communicating the entrance with a source of secondary fluid whereby the flow of pressurized fluid induces the flow of secondary fluid into the passageway with both fluids being discharged from the exit and means for varying the cross-sectional extent of the intermediate portion, said last named means including an annular ring formed from resilient material and having an exterior exposed surface that defines the minimum extent, said ring being deformable to have the exposed surface vary the cross-sectional extent, means for substantially restraining deformation of the remaining portion of the ring and in which there are movable means for mechanically deforming said deformable means to set the cross-sectional extent defined by said means.

2. The invention as defined in claim 1 in which there are means for securing the movable means in one selected position.

3. The invention as defined in claim 1 in which the movable means is responsive to the difference in the values of pressure at the entrance and exit and in which said means reduces said extent as the entrance pressure decreases.

4. The invention as defined in claim 3 in which the deformable means is resilient and tends to oppose deformation by the movable means.

5. The invention as defined in claim 3 in which the difference in pressure tends to urge relative movement of the movable means in one direction and in which there are spring means for resisting said movement.

6. A nozzle for inducing flow of a secondary fluid by using a pressurized fluid comprising means forming a passageway to have an entrance, an exit and an intermediate portion of minimum corss-sectional extent, means for causing a pressurized fluid to flow through the passageway, means for communicating the entrance with a source of secondary fluid whereby the flow of pressurized fluid induces the flow of secondary fluid into the passageway with both fluids being discharged from the exit and means for varying the cross-sectional extent of the intermediate portion, said last named means including an annular ring formed from resilient material and having an exterior exposed surface that defines the minimum extent, said ring being deformable to have the exposed surface vary the cross-sectional extent, means for substantially restraining deformation of the remaining portion of the ring and in which the deformable means is a tubular ring having a hollow interior.

7. The invention as defined in claim 6 in which the exposed surface is normally essentially eliptical.

8. The invention as defined in claim 6 in which the hollow interior forms a closed chamber.

9. The invention as defined in claim 6 in which there are means for communicating the hollow interior with a source of fluid pressure to thereby control the interior pressure of the ring.

* * * * *